US011187509B2

(12) United States Patent
Billings

(10) Patent No.: US 11,187,509 B2
(45) Date of Patent: Nov. 30, 2021

(54) BULLET AND CASING PROJECTILE FOR RIFLED BARREL

(71) Applicant: Chris Lee Billings, Layton, UT (US)

(72) Inventor: Chris Lee Billings, Layton, UT (US)

( * ) Notice: Subject to any disclaimer, the term of this patent is extended or adjusted under 35 U.S.C. 154(b) by 0 days.

(21) Appl. No.: 17/109,794

(22) Filed: Dec. 2, 2020

(65) Prior Publication Data

US 2021/0254954 A1 Aug. 19, 2021

Related U.S. Application Data

(60) Provisional application No. 62/946,049, filed on Dec. 10, 2019, provisional application No. 62/961,428, filed on Jan. 15, 2020.

(51) Int. Cl.
*F42B 14/02* (2006.01)
*F42B 14/06* (2006.01)
*F42B 30/02* (2006.01)

(52) U.S. Cl.
CPC ..... *F42B 14/02* (2013.01); *F42B 14/064* (2013.01); *F42B 30/02* (2013.01)

(58) Field of Classification Search
CPC ..... F42B 14/02; F42B 14/064; F42B 30/02
USPC ..... 42/51
See application file for complete search history.

(56) References Cited

U.S. PATENT DOCUMENTS

| | | | | |
|---|---|---|---|---|
| 6,385,887 | B1 * | 5/2002 | Johnston | F41C 9/08 102/444 |
| 9,175,939 | B1 * | 11/2015 | Wilfong | F42B 5/26 |
| 2007/0234925 | A1 * | 10/2007 | Dunn | F42B 14/064 102/522 |
| 2016/0091289 | A1 * | 3/2016 | Peterson | F42B 5/02 102/501 |
| 2018/0356193 | A1 * | 12/2018 | Yadon | F42B 12/34 |
| 2020/0240758 | A1 * | 7/2020 | Thompson | F42B 10/24 |

* cited by examiner

*Primary Examiner* — Samir Abdosh
(74) *Attorney, Agent, or Firm* — Dowell & Dowell, P.C.

(57) ABSTRACT

A projectile for loading into a rifled barrel includes a casing having a cylindrical body, a forward aerodynamic end, and a free end opposite the aerodynamic end, the cylindrical body of the casing defining an interior cavity extending to and in open communication with the free end. The projectile also has a bullet sized to initially slidably engage the casing along a partial length of the interior cavity through the free end. Upon discharge of propellant, the bullet is forced to slidably engage the casing farther within the cavity, preferably such that an entire length of the bullet is housed within the casing cavity, whereby a circumference of the casing is increased such that the increased circumference of the casing catches barrel rifling of the muzzleloader rifle. This allows a smaller caliber bullet to be used in a fouled barrel, while increasing accuracy of the muzzleloader rifle.

20 Claims, 6 Drawing Sheets

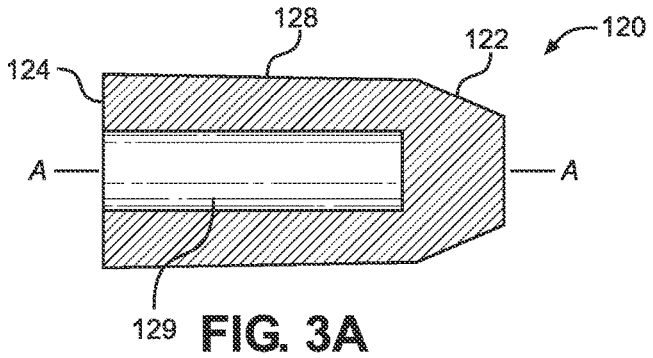
FIG. 3A
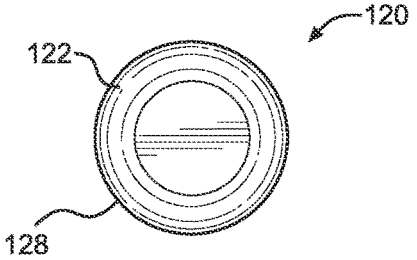
FIG. 3B
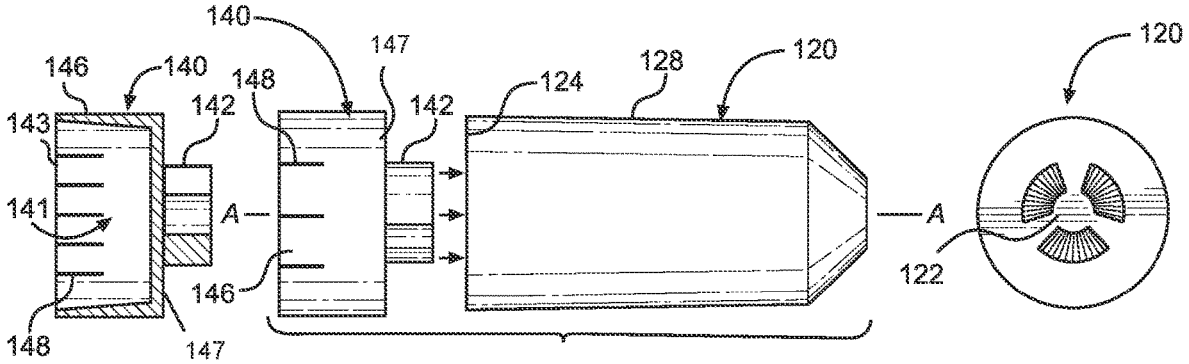
FIG. 4C
FIG. 4A
FIG. 4B
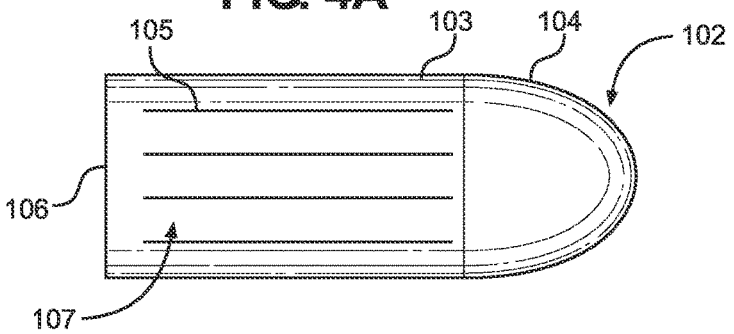
FIG. 5A
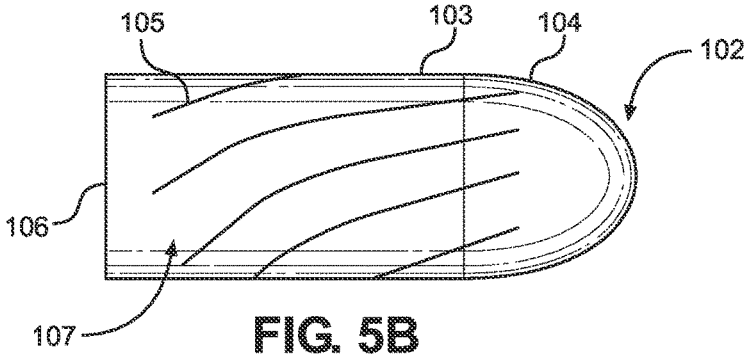
FIG. 5B

BULLET AND CASING PROJECTILE FOR RIFLED BARREL

BACKGROUND OF THE INVENTION

Field of the Invention

The present invention is directed to ammunition projectiles including a bullet and casing wherein the bullet and casing are of a type used with firearms, more specifically firearms having rifled barrels. Preferably, the projectiles are used with muzzleloader firearms, wherein the projectile casing forms a sheath around an outer circumference and front of the bullet. The bullet and casing of the projectile may be loaded into the firearm separately or as a single round, wherein the bullet is partially secured within a cavity of the casing by an inner circumference of the cavity. The projectile of the present invention particularly addresses providing projectiles that are easily loadable and properly catch barrel rifling in muzzleloader firearms with reduced barrel diameters due to fouling or residue build-up.

Brief Description of the Related Art

There are two general classes of firearm: muzzleloader firearms and breechloader firearms. Most modern firearms are breechloader firearms, or a firearm in which a round, including a bullet, propellant, primer, and casing, is inserted or loaded into a chamber integral to a rear portion of a barrel. In contrast, most early firearms where muzzleloaders, or firearms wherein propellant then a bullet are loaded from a muzzle of the firearm.

While breechloaders are certainly the more popular and technologically advanced class of firearms, muzzleloaders are still used today by hunters, competitive shooters, and firearm enthusiasts. As such, there is still a need to improve upon muzzleloader technologies and resolve long standing issues with this class of firearms.

A popular muzzleloader firearm is a muzzleloader rifle. However, muzzleloader pistols are also used. The problems present in muzzleloader rifles are also present in muzzleloader pistols.

A main concern with muzzleloaders is barrel and breech fouling. Fouling is a built-up layer of particulates, including dirt, propellant residue, and moisture, along inner surfaces of the firearm's components. A main source of fouling is the propellant used in muzzleloaders. Black powder or a similar synthetic substitute is deposited into the barrel of the firearm via the muzzle, free from a shell or cartridge found in rounds for breechloaders. Unfortunately, both black powder and synthetic substitutes for black powder are corrosive and hygroscopic. When either are ignited at discharge of the muzzleloader, the resulting residue attracts moisture. If left to settle, the mixture of water moisture and propellant residue will form a layer on inner surfaces that will pit, rust, and corrode such surfaces.

Unfortunately, such layers often develop after only a first or second shot fired from the muzzleloader. To combat fouling, muzzleloader barrels are seasoned to create a protective layer that is at least resistant to fouling. Such seasoning often involves cleaning and heating the barrel before applying a lubricant. Cleaning the barrel removes contaminants and fouling. Heating the barrel causes the metal to expand and open pores in the barrel surface. Applying the lubricant into the heated barrel allows more lubricant to permeate farther into the barrel surface to create a protective barrier.

Loading a muzzleloader firearm after cleaning and before firing a further shot is a strenuous task, as the components of the projectile fit tightly into the barrel. After seasoning a muzzleloader barrel and then firing it several times, it can be extremely difficult to load the muzzleloader with typical components. Sabots are typically used with muzzleloaders to properly align a bullet within a barrel and to create a proper gas seal around the bullet upon discharge and ignition of the propellant. However, the sabot is positioned behind the bullet and collects the bullet in a muzzle-facing seat that adds to the diameter of the projectile in the barrel. Using sabots is necessary with some bullets, but exacerbates the difficulty with loading the projectile into the barrel of the muzzleloader. To ensure accuracy of the muzzleloader, the round, either the bullet directly or through the sabot, must catch barrel rifling to properly spin and ensure a proper trajectory out of the barrel. For bullets of small caliber than the barrel from which they are fired, sabots are necessary to achieve this accuracy.

As such, there is a need in the muzzleloader art for a projectile that is easily loaded, even after several discharges from the firearm, which also maintains a high level of accuracy during each shot.

SUMMARY OF THE INVENTION

It is a primary object of this disclosure to teach a projectile for loading into and firing out of a muzzleloader firearm, the projectile having a casing with a cylindrical body, a forward aerodynamic end, and a free end opposite the aerodynamic end, the cylindrical body defining an interior cavity extending to and in open communication with the free end. Further, the projectile has a bullet sized to slidably engage the casing along a partial length of the interior cavity through the free end. Upon discharge or loading of the muzzleloader firearm, the bullet is forced to slidably engage the casing farther within the cavity, whereby a circumference of the casing is increased, and wherein the increased circumference of the casing catches barrel rifling of the muzzleloader firearm.

A further objective is to teach an embodiment of the projectile optionally having a tail guide with one or more connection members corresponding to one or more connection surfaces along a base end of the bullet, the one or more connection members secured to a cylindrical body having a plurality of rifling guide s each extending along a partial length of the tail guide longitudinally away from the one or more connection members, each rifling guide of the plurality of rifling guides oriented side by side around a circumference of the tail guide, wherein each rifling guide is connected to each adjacent rifling guide by a line of weakness. The tail guide is removably secured to the bullet to provide additional stability in the barrel.

In another embodiment, each rifling guide separates from each adjacent rifling member along the line of weakness upon discharge of the muzzleloader firearm.

Yet another embodiment of the projectile includes a free end of each rifling guide together forming an outer edge of a cavity extending within a longitudinal length of the tail guide, wherein the cavity is shaped to accommodate gun powder.

In another embodiment of the projectile, upon discharge of the muzzleloader rifle, each rifling guide extends radially outward such that each rifling guide is positioned to contact the barrel rifling of the muzzleloader rifle. This increases the accuracy of the projectile due to the rifling guides further interacting with the barrel rifling upon discharge of the muzzleloader.

Another embodiment of the invention includes a bullet optionally having a partially hollow interior. The partially hollow interior extends along a portion of a longitudinal length of the bullet and is open along a free base end of the bullet. The hollow interior of the bullet may be configured to house gunpowder when loaded in the muzzleloader rifle. Upon discharge of the muzzleloader, the bullet is forced to slidably engage the casing farther within the cavity. The ignition of the propellant causes the bullet to expand radially outward away from a central longitudinal axis of the cavity, wherein the bullet expanding farther causes the casing to engage the barrel rifling of the muzzleloader rifle. A closed end of the cavity opposite the open base end traps gas in order to cause the propellant to force the bullet and casing forwards and out of the muzzle of the rifle. The cavity is preferably cylindrical and uniform in diameter along a length of the bullet, but may be generally conical, such that the diameter of the interior decreases along the length of the bullet toward a forward end of the bullet.

In another embodiment, the casing further comprises an opening along the forward aerodynamic end into the interior cavity. The opening is sized to allow a forward end of the bullet to extend beyond the forward aerodynamic end upon discharge of the muzzleloader wherein the bullet fully slidably engages the interior cavity of the casing. In this embodiment, there may be a hollow interior extending along a longitudinal length of the bullet like previous embodiments, or there may be a tail guide associated with the bullet, as with other embodiments.

BRIEF DESCRIPTION OF THE DRAWINGS

A better understanding of the invention will be had with respect to the accompanying drawings wherein:

FIG. 3A is a cross-sectional view of a bullet of a projectile according to an embodiment of the present invention;

FIG. 3B is a front view of the bullet shown in FIG. 3A;

FIG. 4A is a side view of a bullet and tail guide of a projectile according to an embodiment of the present invention;

FIG. 4B is a rear view of the bullet of the embodiment shown in FIG. 4A;

FIG. 4C is a cross-sectional view of the tail guide shown in FIG. 4A;

FIG. 5A is a side view of a casing of a projectile according to an embodiment of the present invention;

FIG. 5B is a side view of a casing of a projectile according to another embodiment of the present invention;

DESCRIPTION OF THE PREFERRED EMBODIMENT

It will be appreciated that numerous specific details have been provided for a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description is not to be considered so that it may limit the scope of the embodiments described herein in any way, but rather as merely describing the implementation of the various embodiments described herein.

The description that follows, and the embodiments described herein, are provided by way of illustration of an example, or examples, of particular embodiments of the principles of the present invention. These examples are provided for the purposes of explanation, and not limitation, of those principles and of the invention. It will also be appreciated that similar structures between embodiments are marked with identical reference numbers for ease of reference.

The present invention solves the problem of muzzleloader projectiles not fitting within a muzzleloader rifle barrel after one or more discharges of the rifle and/or subsequent loss of accuracy due to reduced contact with barrel rifling by teaching a reduced-diameter projectile that easily inserts into a muzzleloader and subsequently expands within the barrel upon discharge of the muzzleloader rifle.

Figure 1:
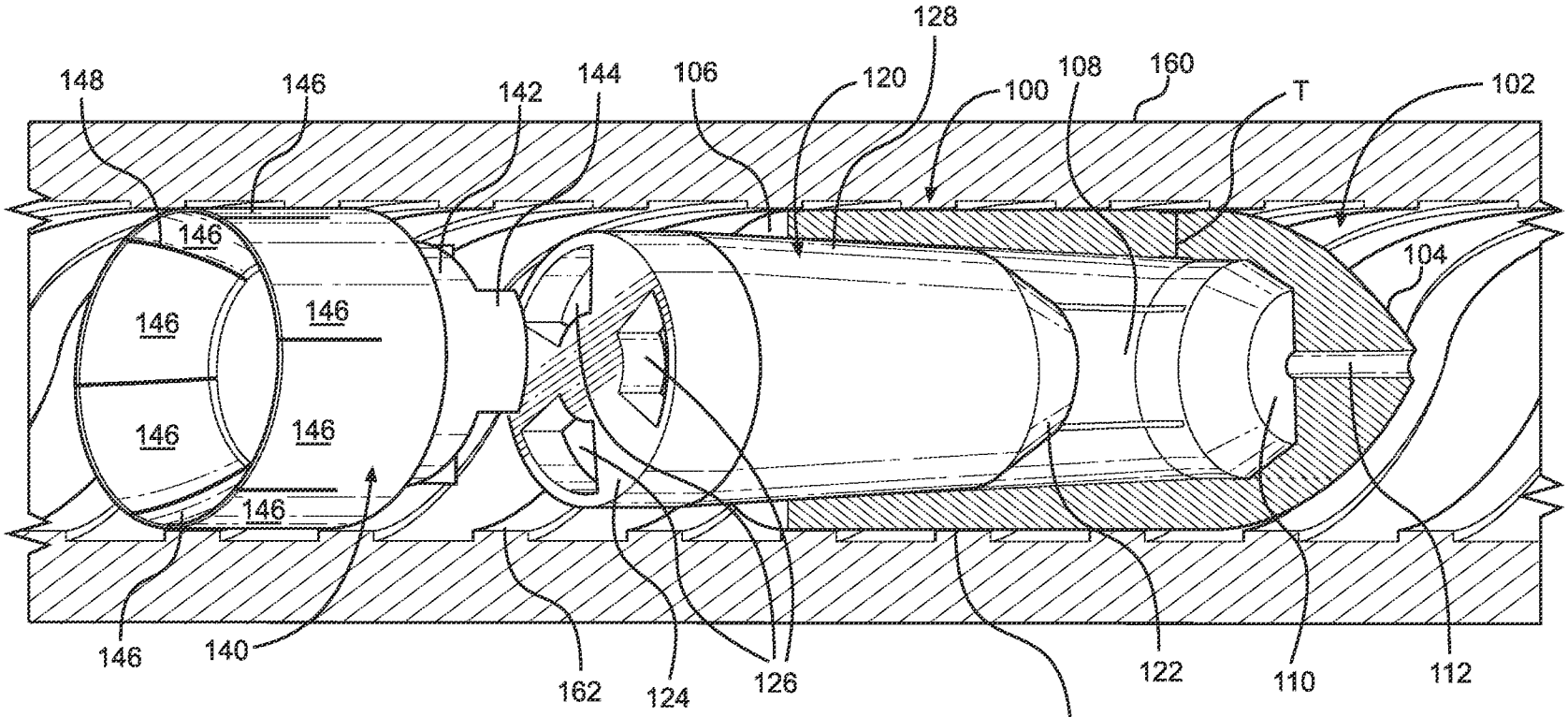
FIG. 1 is a cross-sectional view of a rifle barrel and an exploded view of a projectile within said rifle barrel according to an embodiment of the present invention.

With continued reference to the drawings, FIG. 1 provides an exemplary embodiment of a projectile 100 of the present invention within a rifled barrel 160. The projectile 100 of the provided embodiment includes a casing 102, a bullet 120, and, optionally, a tail guide 140. Further embodiments of the projectile 100 may or may not include a tail guide 140, and such embodiments will be discussed further herein.

The casing 102 includes a forward, or aerodynamic, end 104 oriented toward a muzzle of the rifle. A free, open end 106 of the casing 102 is oriented oppositely relative to the forward end 104, towards a breech of the rifle, and is in open communication with an inner cavity 108 of the casing 102. The inner cavity 108 extends a partial length of the casing 102 in this embodiment and is longitudinally defined by a forward surface 110. In this embodiment, the forward surface 110 includes a central portion perpendicular to a length of the casing 102 and a radial surface extending around and away from the central portion. The forward surface 110 of the inner cavity 108 defines an end along a range of slidable movement possible between the bullet 120 and inner cavity 108 of the casing 102. The inner end 110 stops the bullet 120 from sliding any farther within the inner cavity 108. In this manner, the forward end 110 is used to ensure consistent expansion of the casing 102 by providing a repeatable positioning of the bullet 120 relative to the casing upon ignition of the propellant.

The inner cavity 108 of the casing 102 is preferably not uniform in diameter along its length moving from the free end 106 toward the forward end 104 of the casing 102. However, a portion or the entire length of the inner cavity 108 may be uniform in diameter. Preferably, the diameter of the inner cavity 108 gradually decreases along the entire length or a portion of the length of the inner cavity moving from the free end 106 toward the forward surface 110.

The casing 102 further includes a cylindrical body 103 that is adjacent to and contiguous with the forward end 104. Preferably, the diameter of the cylindrical body 103, measured outer surface to outer surface, remains uniform along a longitudinal length of the cylindrical body. In conjunction with the decreasing diameter of the inner cavity 108, it is therefore preferable for a thickness T of the cylindrical body to increase when moving from free end 106 towards forward end 104. The cylindrical body 103, alone or in combination with the forward end 104, defines the inner cavity 108, which extends therein.

An initial diameter of the casing 102, or the diameter without the bullet 120 inserted in the inner cavity 108, is preferably no larger than the diameter of the corresponding rifled barrel 160, measured between oppositely oriented lands, in which is the casing 102 and projectile 100 is to be inserted. This allows the casing to be easily inserted into the rifled barrel 160.

An opening 112 extends between the forward surface 110 of the inner cavity 112 and surface of the forward end 104 of the casing 102. The opening 112 provides an escape for gas and other material to evacuate a volume of space defined within the inner cavity 108 between the bullet 120 and forward surface 110, specifically as the bullet slides towards the forward surface. In other embodiment of the casing 102 and projectile 100, the opening 112 is optional.

With continued reference to FIG. 1, the bullet 120 is generally cylindrical in shape such that a diameter of the bullet is consistent along a portion of its longitudinal length, while the diameter of the bullet changes along at least another portion of the bullet. The bullet 120 includes a body 128 between a forward end 122 and a base end 124. The forward end 122 of the bullet 120 is typically rounded or curved to provide aerodynamics, as well as to correspond to a shape and dimensions of the forward surface 110 of the inner cavity 108. A diameter of the body 128 is chosen to allow the bullet 120 to slide into the inner cavity 108 of the casing 102 via the free end 106, such that the bullet is slidably secured to the casing along at least a partial length of the bullet. In other embodiments of the projectile 100, the bullet 120 may be differently shaped as common in the art. The precise shape of the bullet 120 is not important in and of itself. More important is that the bullet 120 and inner cavity 108 of the casing 102 are shaped to correspond to each other to create the desired expansion of the casing 102 in the barrel 160 after ignition and while the projectile 100 is traveling through the barrel. In all embodiments, the diameter of the bullet 120 is undersized in comparison to the diameter of the rifled barrel 160. This is to compensate for the casing 102 adding to the overall diameter of the projectile 100 when combined with the bullet 120.

In the embodiment shown in FIG. 1, a base end 124 of the bullet 120 includes a plurality of connection surfaces 126, which in this case are channels extending into the bullet 120 along its longitudinal length. The plurality of connection surfaces 126 correspond to a plurality of connection members 144 of a tail guide 140. The tail guide 140 slidably engages the bullet 120 along the connection members 144 and connection surfaces 126. The tail guide 140 may include a base 142 that is further insertable into the base end 124 and/or engages the base end of the bullet 120 along a flush surface 147. The tail guide 140 further includes a plurality of rifling guides 146 oriented toward a breech end of the barrel 160 and side by side around a circumference of the tail guide. Each rifling guide 146 is connected to each adjacent rifling guide by a line of weakness 148.

An alternate embodiment of the projectile 100 may include a tail guide 140 without a base 142 or connection members 144. In such an embodiment, the tail guide 140 would contact the base end 124 of the bullet 120 along the flush surface 147. The bullet 120 would also have no need for corresponding connection surfaces. No part of the tail guide 140 would therefore be inserted into the bullet 120.

The elements of the projectile 100 are shown in FIG. 1 in a base, default, or non-discharged state, such as how the elements would appear while or after being loaded into the barrel 160, but before the projectile is discharged from the muzzleloader rifle upon ignition of the propellant.

Figure 2:
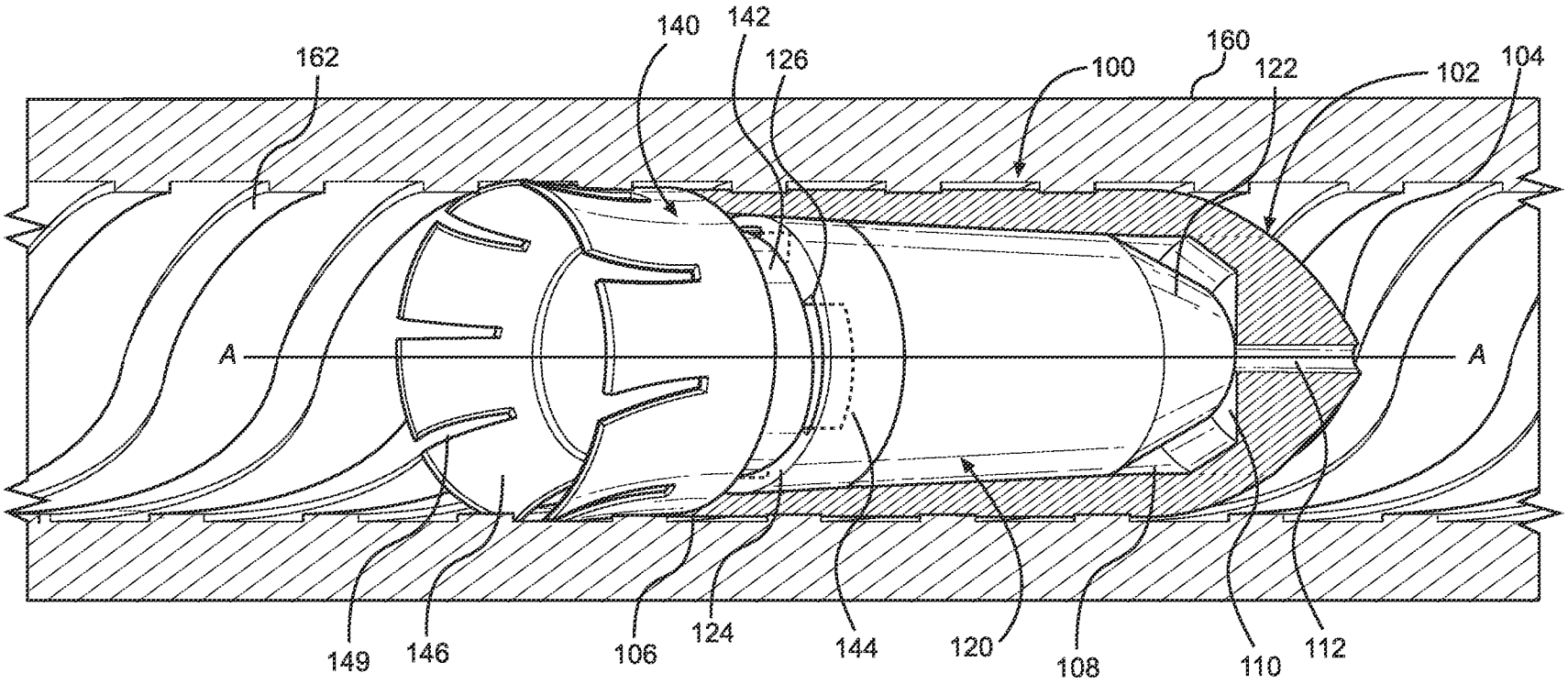
FIG. 2 is a cross-sectional view of a rifle barrel and a perspective view of a projectile according to FIG. 1 within said rifle barrel.

Referring now to FIG. 2, the projectile 100 of FIG. 1 is shown after ignition of the propellant and as the projectile is propelled along the rifling 162, but before being discharged from the muzzle of the muzzleloader rifle. The bullet 120 is fully slidably engaged within the inner cavity 108, such that the forward end 122 of the bullet contacts or is adjacent to the forward surface 110 of the inner cavity. The full insertion of the bullet 120 into the casing 102 causes a circumference and the diameter of the casing 102 to increase and expand into barrel rifling 162 of the barrel 160. Insertion of the bullet 120 fully in the casing 102 causes reliable and consistent expansion of the casing into the rifling 162. Further, the ignition of the propellant causes adjacent rifling guides 146 of the tail guide 140 to separate along their respective lines of weakness 148 to create slits 149 between each rifling guide 146. The rifling guides each extend away from a central axis A and toward the barrel rifling 162. Contact between each rifling guide 146 and the barrel rifling 162 is desired to increase accuracy of the projectile after it leaves the barrel 160. Opening 112 allows gas to exit the inner cavity 108 as the volume within the cavity is compressed. While the opening 112 is preferable, it is not necessary in view of additional structures that may be present. Such structures are detailed in further embodiments.

While the tail guide 140 is shown as having a plurality of rifle guides 146, the tail guide is operable without rifle guides 146. In such an embodiment, the tail guide 140 would still have a propellant holding area 141. Further, rifle guides that are separated before ignition are conceivable. In such an embodiment, there would be no lines of weakness 148 and only pre-existing slits 149.

Since the largest diameter of the projectile, the casing, is changeable between a default state and a discharged state, the present invention as demonstrated in the embodiment provided in FIGS. 1 and 2 allows a projectile to be easily inserted into a muzzleloader rifle with fouling in the default state while still providing a highly accurate projectile upon discharge in the discharged state. Contact between a projectile and barrel rifling is crucial with any firearm having a rifled barrel, be it a muzzleloader or breechloader. Through expansion of the casing 102 dimensions due to the bullet 120 fully engaging the casing, the present invention ensures that the projectile 100 properly engages the barrel rifling 162.

Referring now to FIGS. 3A and 3B, an alternate embodiment of a bullet 120 is shown having a channel 129 extending along longitudinal axis A and a partial length of the bullet. The channel 129 is open at the base end 124 of the bullet 120. The channel 129 preferably has a consistent diameter along the longitudinal length in this embodiment. However, the diameter of the channel 129 may decrease along the length of the bullet 102 from the base end 124 to the forward end 122. FIG. 3B shows a front view of the bullet 120 shown in FIG. 3A. As shown, the diameter of the body 128 decreases slightly moving along the length of the bullet 120 from the base end 124 toward the front end 122. This slight decrease in diameter allows the bullet to more easily slidably engage the casing 102. The bullet 120 of FIGS. 3A and 3B is not designed to be used with a tail guide 140. Instead, the channel 129 is intended to provide surface area within and along a length of the bullet 120 upon which heated gases may in turn heat the bullet upon ignition of the propellant. In turn, the bullet 120 expands causing the casing 102 to expand into the rifling 162. The channel 129 may therefore be shaped to ensure the greatest amount of surface area or to ensure consistent expansion of the bullet 120 along its length.

Other projectile 100 embodiments may include a bullet 120 without a channel 129 combined with various embodiments of the casing 102, and optionally, the tail guide 140 described herein.

FIGS. 4A-4C depict several views of an embodiment of the bullet 120 and tail guide 140 assembly. This embodiment of the bullet 120 and tail guide 140 is similar to the embodiment shown in FIGS. 1 and 2. The primary difference between the referenced bullet 120 and tail guide 140 embodiments is that the base 142 serves as the connection member 144 in the embodiment shown in FIG. 4A-4C. In this configuration the tail guide 140 and bullet 120 are permitted to connect flush along the base end 124 and surface 147. However, as the bullet 120 is inserted into the inner cavity 108 of the casing 102 and the tail guide 140 is not, the tail guide has a greater diameter than the bullet. Further, the tail guide 140 need not be rotatably secured, or secured in any way, to the bullet 120. Forces applied upon the tail guide 140 may simply cause the tail guide to push the bullet 120 and casing 102 forward. However, the tail guide 140 may be secured to the bullet 120 such that rotational movement of the tail guide 140 upon ignition of the propellant and interaction with barrel rifling is transferred to the bullet 120, such that bullet is further rotated.

With all embodiments of the projectile 100 utilizing a tail guide 140, the tail guide is intended not to travel along with the projectile upon its exit from the barrel. Instead, the tail guide 140 falls off or away from the projectile 100 upon exiting the muzzle of the barrel.

The forward end 122 of the bullet 120 may be shaped as is typical of non-ball bullets. Therefore, the forward end 122 may be angled from the body 128 toward a point culminating at axis A, or the rear end may be angled toward a flat central portion perpendicular to axis A. Further, the forward end 122 may be rounded or curved, as is typical of other bullets.

FIG. 4B shows the base end 124 of the bullet 120 provided in FIG. 4A. The connection surface 126 of the bullet 120 is shaped as three separate channels in this embodiment. The base 142 inserts into the connection surface 126 of the bullet 120. The connection between the base 142 and/or connection member 144 of the tail guide 140 and connection surface 126 of the bullet need not be of any specific shape, configuration or orientation.

Referring to FIG. 4C, a cross-sectional view of the tail guide 140 embodiment is provided. In this embodiment, the base 142 is shaped as three members to be insertable into the connection surface 126 shaped as three channels along the base end 124 of bullet 120. A propellant holding area 141 is formed by a hollow cavity extending into the tail guide 140 opposite the base 142. The area is partially formed by the rifling guides 146 connected along their respective lines of weakness 148. The area 141 is open along an end 143, wherein propellant is either packed or the tail guide 140 is inserted over in the barrel 160. Ignition of the propellant causes the rifling guides 146 to split along the respective lines of weakness 148 and extend toward the barrel rifling 162, as the area 141 holding the propellant allows ignition forces to act toward the muzzle and outwardly away from axis A.

While the bullet 120 embodiments of FIGS. 3A-3B and 4A-4C are both usable with the projectile 100 and insertable into and slidably engagable with the casing, there are slight differences in operation between the two bullet 120 embodiments that should be highlighted. The bullet 120 embodiment of FIGS. 4A-4C has been discussed in greater detail with regards to FIGS. 1 and 2. However, the bullet 120 embodiment of FIGS. 3A-3B does not utilize a tail guide 140 to provide further stability and rotational movement within the barrel 160. Instead, the channel 129 is meant to provide a length in which heat and energy released upon propellant ignition travels and is transferred to the bullet 120. This heat and energy transfer, while simultaneously forcing the bullet 120 to further slidably engage the casing 102, causes the bullet 120 to expand radially outward from axis A. While the bullet 120 slidably engaging the casing 102 along the inner cavity 108 causes the casing to expand and catch the barrel rifling 162, the expansion of the bullet causes further expansion of the casing. An embodiment of the projectile 100 utilizing the casing 102 and bullet 120 embodiment of FIGS. 3A-3B is best utilized in barrels with very restricted diameters, as bullet and casing may be more easily adapted to fit within the barrel 160. The embodiment of FIGS. 4A-4C is not as easily adapted, as the tail guide 140 may be damages along the lines of weakness 148 if forcibly inserted into the barrel.

Referring now to FIGS. 5A and 5B, several side views of casing 102 embodiments are shown to illustrate an outer surface 107 of the casing. The outer surface 107 of the casing 102 is primarily important to demonstrate lines of weakness or scoring 105 preferably present. The scoring 105 may simply be notches or lines in the outer surface 107, or it may be an opening through the outer surface and into the inner cavity 108. With scoring 105 that provides an opening between the outer surface 107 of the casing 102, the opening 112 in the forward end 104 of the casing need not be present as previously discussed. The scoring may be parallel to central axis A, as shown in FIG. 5A, or may curve along a longitudinal length of the outer surface 107, as shown in FIG. 5B. No specific orientation of the scoring is necessary. However, linear or elongated scoring 105 extending along the longitudinal length of the casing 102 is preferred when scoring is present. It is further preferable for the scoring 105 to extend along the cylindrical body 103, but it is possible for the scoring to extend along both the cylindrical body and the forward end 104 of the casing 102.

The scoring 105 allows the casing 102 to expand in an expected manner when the bullet 120 fully slidably engages the inner cavity 108 of the casing 102. The casing 102 expands along the scoring 105, allowing for a controlled expansion of the casing into the barrel rifling 162, to ensure the expansion is reliable and consistent. Controlled expansion of the casing 102 allows for more surface area of the casing to contact the barrel rifling 162 relative to no scoring being present. Further, without scoring 105, the casing 102 may crack in unexpected ways. This would affect projectile 100 accuracy or could even damage the barrel 160.

Figure 6:
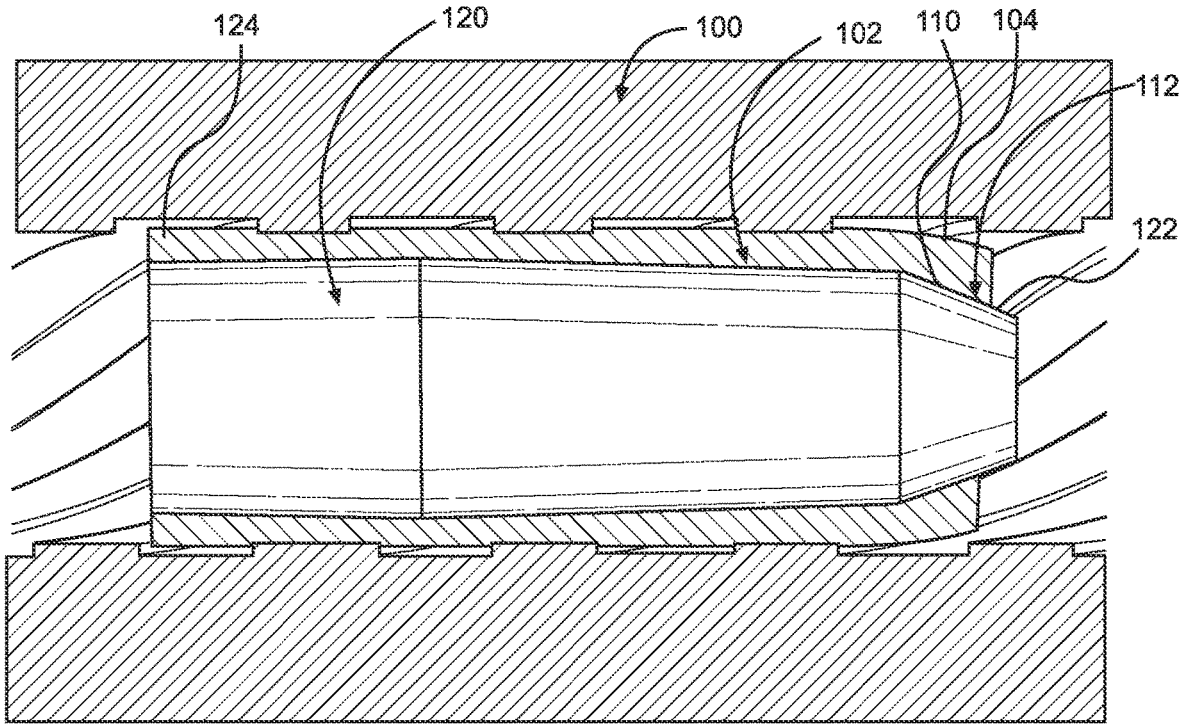
FIG. 6 is a cross-sectional view of a rifle barrel, a cross-sectional view of a casing, and a side view of a bullet of a projectile according to an embodiment of the present invention.

Referring to FIG. 6, another embodiment of the projectile 100, including the bullet 120 and casing 102, is highlighted. In this embodiment, the forward end 104 of the casing 102 is retracted relative to the embodiments shown in FIGS. 1, 2, 5A and 5B to allow the forward end 122 of the bullet 120 to extend beyond the forward end 104 of the casing when the bullet is fully engaged with the casing. The opening 112 in the forward end 104 of the casing 102 in this embodiment is not only a release for compressed gas to escape the inner cavity 108. In this embodiment, the opening 112 is continuous with the forward surface 110 such that the bullet 120 both contacts the forward surface and extends through the opening. For this embodiment of the casing 102, the bullet 120 embodiment of FIGS. 3A and 3B is preferred. However, other described embodiments of the bullet 120 and tail guide 140 are usable with the projectile 100 of FIG. 6.

Figure 7:
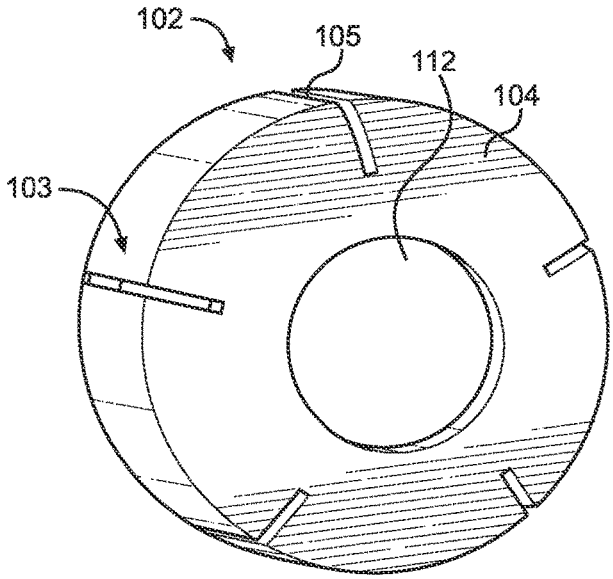
FIG. 7 is a front perspective view of the casing of FIG. 6.

FIG. 7 illustrates a front perspective view of the casing 102 shown in FIG. 6. A better view of the opening 112 is shown. Further, scoring 105 is shown extending along the body 103 of the casing 102 and along the forward end 104. As with other embodiments of the casing 102, the scoring 105 may only extend along the cylindrical body 103 and/or may by non-linear and/or may not fully penetrate the thickness T of the casing.

Other embodiments of the projectile 100 may not include scoring 105. Some materials used to create the casing 102 may safely and consistently expand in a predictable manner without the need for scoring 105, which is provided mainly to prevent cracking or fracturing of the casing during expansion. Such fracturing of the casing could impact accuracy of the bullet and could also create a safety issue.

Figure 8:
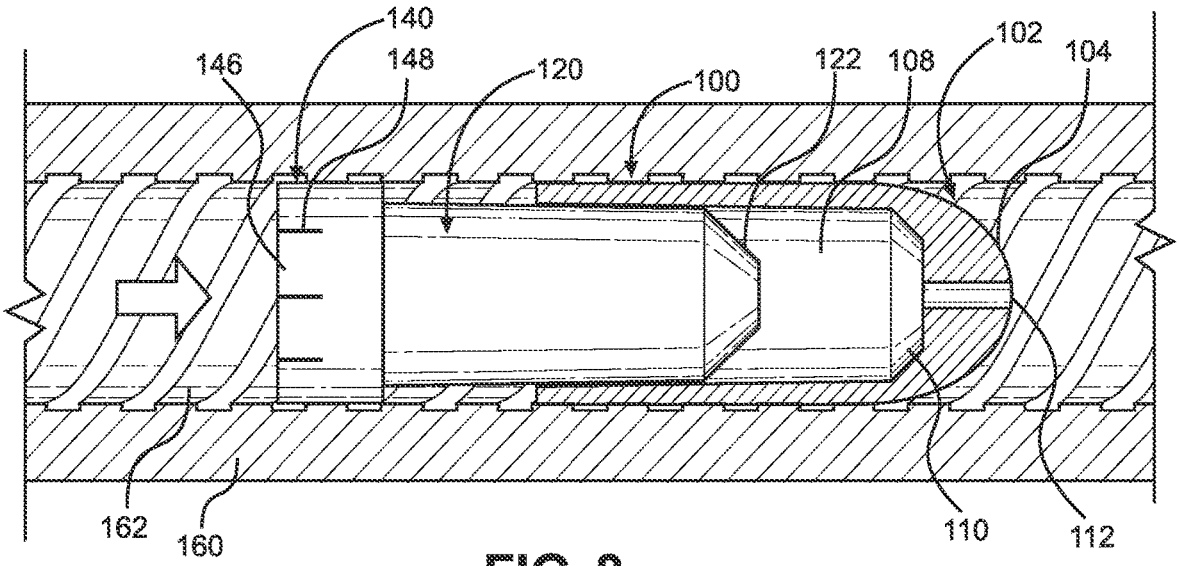
FIG. 8 is a cross-sectional view of an embodiment of the projectile before discharge from a rifle barrel.
Figure 9:
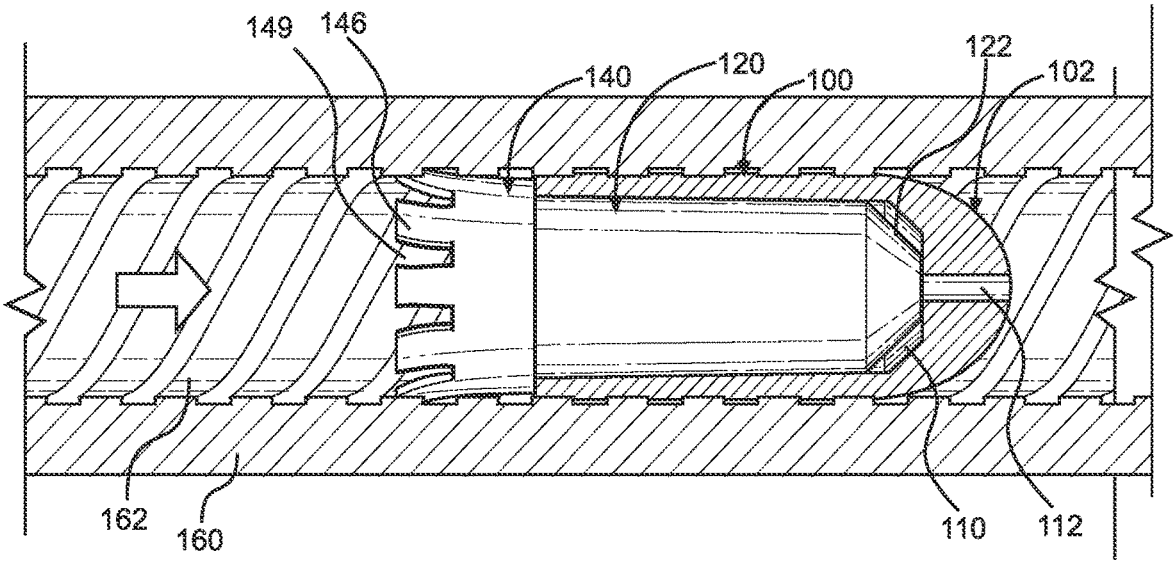
FIG. 9 is a cross-sectional view of the embodiment of the projectile shown in FIG. 8 after ignition of the propellant within the rifle barrel.

Referring now to FIGS. 8-13, several different methods of loading the projectile 100 embodiments of the present invention into a muzzleloader. FIGS. 8 and 9 show one method of loading the projectile 100. In FIG. 8, the bullet 120 is inserted forward end first into the inner cavity 108 of the casing 102, such that only a partial length of the bullet is inserted into the inner cavity. The insertion of the bullet 120 should not cause the casing 102 to expand in diameter beyond the diameter of the barrel 160, whether or not it is fouled or clean. The insertion of the bullet 120 into the casing 102 in this embodiment occurs before inserting either into the barrel 160.

The tail guide 140 is either secured to the bullet 120, as previously discussed, and inserted together with the bullet and casing 102, or the tail guide is separately inserted into the barrel 160 first. Either way, the free end 143 of the tail guide 140 is inserted first, such that the rifling guides 146 are positioned towards the breech of the firearm. If loaded separately from the tail guide 140, the bullet 120 and casing 102, secured together, are then loaded such that the base end 124 of the bullet is inserted first and the forward end 104 of the casing is directed toward the muzzle of the barrel 160. Upon loading the projectile 100, the casing 102, bullet 120, and tail guide 140 are positioned within the barrel 160 as shown in FIG. 8 before being discharged. As previously discussed, the tail guide 140 may simply contact the bullet 120 along respective co-planar surfaces or may be otherwise connected or inserted into the bullet. Before discharge, propellant is held in the holding area 141 of the tail guide 140 and in the barrel 160 between the breech and projectile 100.

Upon ignition of the propellant, as shown in FIG. 9, the rifling guides 146 separate along respective lines of weakness 148 and widen to create slits 149 between each rifling guide. The force and gas generated by the ignition of the propellant act on the tail guide 140 to force the bullet 120 to slide farther into the inner cavity 108 of the casing 102 toward the forward surface 110. Air in the inner cavity 108 is forced through the opening 112 and/or through scoring 105 in the casing 102 as the volume of the inner cavity is compressed. The casing 102 expands in diameter and circumference as the bullet 120 is forced farther into the inner cavity 108, causing the casing to catch and grip the barrel rifling 162. Uniform expansion of the casing 102 is achieved when the forward end 122 of the bullet 120 meets, contacts, or rests adjacent to the forward surface 110 of the inner cavity 108. The force of the propellant, and contact with the barrel rifling 162, propels the projectile forward and to rotate. This rotational movement improves accuracy as the projectile is discharged from the muzzle.

Figure 10:
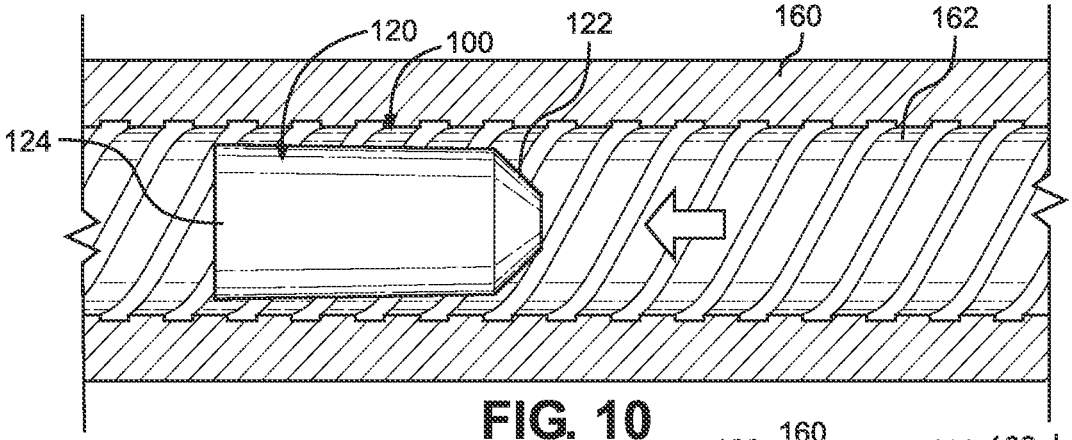
FIG. 10 is a cross-section view of a rifle barrel illustrating loading an embodiment of the projectile into a muzzleloader rifle.
Figure 11:
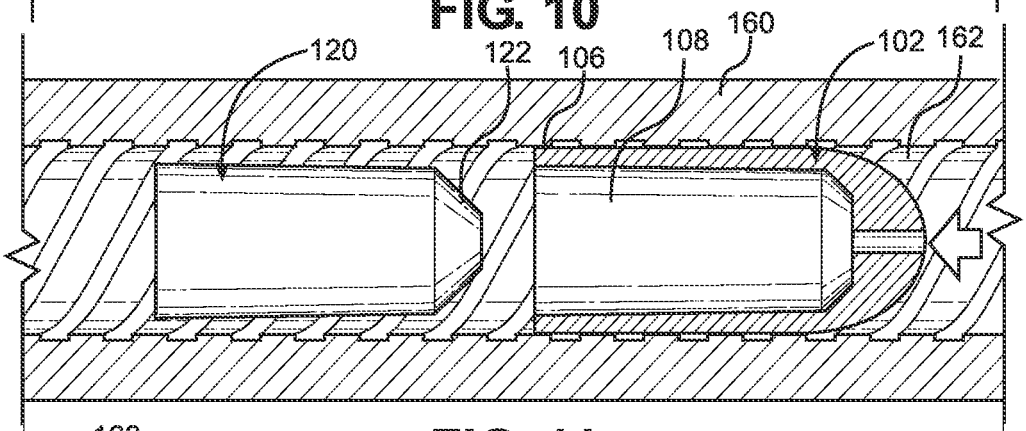
FIG. 11 is a further cross-section view of the rifle barrel illustrating loading an embodiment of the projectile following FIG. 10.
Figure 12:
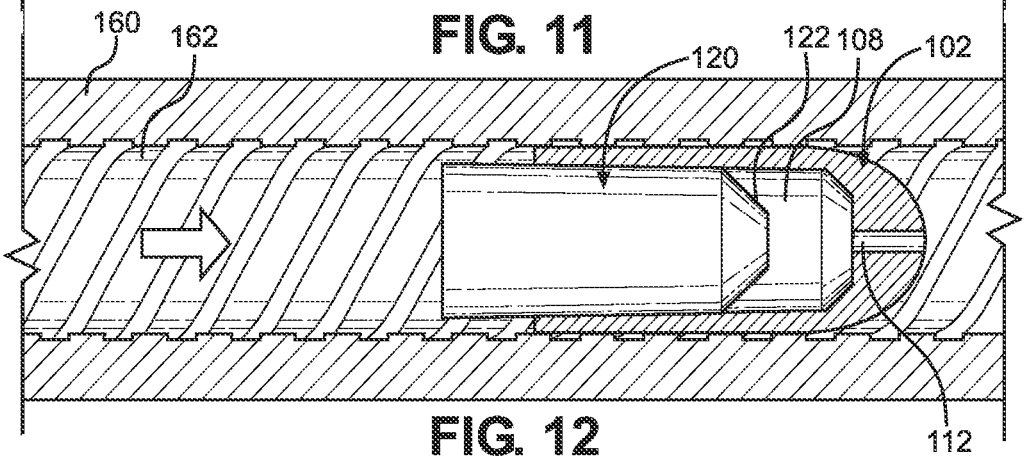
FIG. 12 is a further cross-section view of the rifle barrel illustrating loading an embodiment of the projectile following FIG. 11.
Figure 13:
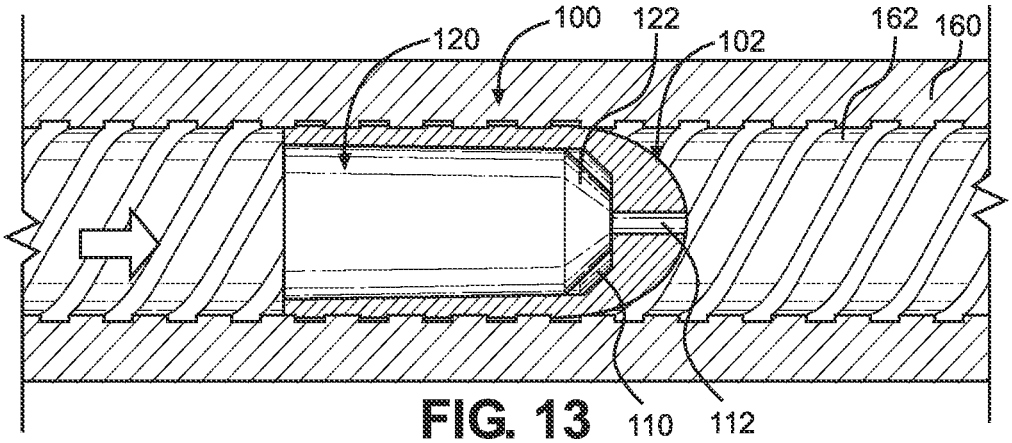
FIG. 13 is a further cross-section view of the rifle barrel illustrating loading an embodiment of the projectile following FIG. 12.

FIGS. 10-13 show an alternative method of loading the projectile 100. In this embodiment, after inserting propellant into the barrel 160 via the muzzle, the bullet 120 alone is inserted into the barrel. The base end 124 is inserted first towards the breech, with the forward end 122 directed toward the muzzle of the barrel 160. This step is shown in FIG. 10. In the next step, shown in FIG. 11, the casing 102 is inserted in the barrel 160 after insertion of the bullet 120. The free end 106 of the casing 102 is inserted first into the barrel such that the free end is slidable over the forward end 122 of the bullet 120. The forward end 104 of the casing is directed toward the muzzle of the barrel 160. Next, FIG. 12 shows the casing 102 forced over the bullet 120 such that a partial length of the bullet is secured within the inner cavity 108 of the casing. Upon ignition of the propellant, force and gases generated by the ignition force the bullet 120 to slidably engage the casing 102 along the entire length of the bullet within the inner cavity 108, as shown in FIG. 13. As such, the casing 102 is forced partially over the bullet 120 during loading, and the bullet is forced fully into the casing during ignition. The casing 102 expands in diameter and circumference as the bullet 120 is forced farther into the inner cavity 108, causing the casing to catch and grip the barrel rifling 162. Uniform expansion of the casing 102 is achieved when the forward end 122 of the bullet 120 meets, contacts, or rests adjacent to the forward surface 110 of the inner cavity 108. This embodiment of the method may further include a tail guide 140 inserted first and closer to the breech relative to the bullet 120 and casing 102, as with the other embodiments.

The embodiment of FIGS. 8 and 9 and the embodiment of FIGS. 10 through 13 are provided to highlight that the projectile may be loaded part-by-part into the muzzleloader firearm, loaded as a single piece with all parts secured together, or a combination thereof. Loading the bullet 120 first, then the casing 102 separately, is easier than loading the bullet and casing together, wherein the bullet is at least partially inserted into the inner cavity 108 loading. However, while not advantageous, loading the bullet 120 and casing 102 together is possible. The two provided illustrations of the methods for loading the projectile 100 are exemplary only and do not limit the other combinations.

While the bullet embodiment of FIGS. 3A-3B was shown in the method illustrated in FIGS. 10-13 and the bullet embodiment of FIGS. 4A-4C was shown in the method illustrated in FIGS. 8-9, the bullet 120 embodiments and methods for loading the projectile 100 are interchangeable. Further, different casing 102 embodiments may be used in either method and with any possible bullet 120 configuration. The tail guide 140 embodiments and methods of loading are likewise interchangeable in combination with a corresponding bullet 120 that functions properly with a given tail guide embodiment. The illustrations of the methods provided in FIGS. 8-13 are exemplary of the methods of loading the projectiles only and do not limit the possible combinations of bullet 120 and casing 102 and other discussed elements.

The amount of expansion of the casing 102 upon discharge may be controlled through the use of either differently sized or angled inner cavities 108 and/or differently sized bullets 120. In order to provide consistency and further measure of control to the user, it is preferable to maintain the same-sized casing 102, in regards to both the overall diameter of the casing, size and shape of the inner cavity 108, and position of the forward surface 110. In this manner, the size of the bullet 120 becomes the only variable in order to give the user control over how much expansion is desired in a given rifled barrel. Even though an aim of the instant invention is to reduce excess work in loading a scored muzzleloader firearm, preferences of the user must still be accounted for in terms of firing and accuracy of the projectile 100.

For example, expected build-up in a .50 caliber barrel upon one or more uses would lead to portions of the barrel being less than .50 caliber, or hypothetically .49 caliber. The casing 102 would therefore ideally be .49 caliber, or slightly smaller in heavily fouled barrels, to more easily fit into the barrel. As the lands of the barrel are originally .50 caliber, the grooves are hypothetically .51 caliber, as they have a greater diameter groove-to-groove than the land-to-land diameter. In a fouled barrel then, there is a .02 caliber difference between groove and fouled-land. The bullet 120 to be inserted into the casing 102 can therefore be chosen to determine how far the casing expands in either direction along that .02 caliber difference. A bullet 120 with a larger diameter would cause greater expansion of the casing 102, all other dimensions of the projectile being equal. Further, fouling is not typically uniform, and neither are the land surfaces after long-term and/or repeated use of a rifle. Differently sized bullets 120 and a casing 102 with identical dimensions allows a user to test fire the rifle to find the preferred bullet to pair with a given casing, much like sighting a scope.

Differently-sized casings 102 are of course necessary between differently sized rifle barrels. Further, other dimensions of the projectile 100 may be changed as necessary and such changes are not limited to the bullet 120.

While it is readily obvious to use the projectile embodiments described herein with muzzleloader firearms, the concepts described herein are applicable to rounds used in breechloader firearms, as well. Namely, it would be possible to use a casing over the end of a round or bullet inserted into a breechloader firearm, wherein the bullet of the round inserted itself farther into the end of the casing upon ignition causing expansion of the casing in the barrel to better catch on rifling. As such, the embodiments described herein may be used with breechloader firearms (i.e. non-muzzleloader firearms). Further, the firearms, either muzzleloaders or non-muzzleloaders, are not limited to rifles and handguns. The rifled barrel embodiments described herein may be used with any applicable firearm, including, but not limited to, handguns, long guns, rifles, shotguns, carbines, machine guns, submachine guns, automatic rifles, assault rifles, personal defense weapons, battle rifles, etc.

I claim:

1. A projectile for loading into and firing out of a rifled barrel, comprising:

a casing having a cylindrical body, a forward aerodynamic end, and a free end opposite the aerodynamic end, at least the cylindrical body defining an interior cavity within the casing extending to and in open communication with the free end; and a bullet sized to slidably engage within and to the casing along at least a partial length of the interior cavity through the free end, wherein a front end of the bullet engages the interior cavity toward a forward surface of the interior cavity and forward aerodynamic end of the casing;

wherein upon loading of the projectile or ignition of a propellant, the bullet is slidably engageable farther within the interior cavity, a circumference of the casing is correspondingly increased, and the increased circumference of the casing catches barrel rifling of the rifled barrel.

2. The projectile of claim 1, further comprising a tail guide having one or more connection members corresponding to one or more connection surfaces along a base end of the bullet, the one or more connection members secured to a cylindrical body having a plurality of rifling guides each extending along a partial length of the tail guide longitudinally away from the one or more connection members, each rifling guide of the plurality of rifling guides oriented side by side around a circumference of the tail guide, wherein each rifling guide is connected to each adjacent rifling guide by a line of weakness.

3. The projectile of claim 2, wherein each rifling guide separates from each adjacent rifling guide along the line of weakness upon discharge of the muzzleloader rifle.

4. The projectile of claim 3, wherein a free end of each rifling guide together forms an outer edge of a cavity extending within the tail guide, wherein the cavity is shaped to accommodate the propellant.

5. The projectile of claim 3, wherein, upon discharge of the muzzleloader rifle, each rifling guide extends radially outward such that each rifling guide is positioned to contact the barrel rifling of the muzzleloader rifle.

6. The projectile of claim 1, wherein the bullet has a partially hollow interior.

7. The projectile of claim 6, wherein the partially hollow interior extends along a longitudinal length of the bullet and is closed along a forward end and is open along a base end of the bullet.

8. The projectile of claim 7, wherein the partially hollow interior of the bullet is configured to house the propellant.

9. The projectile of claim 8, wherein, as the bullet is forced to slidably engage the casing farther within the inner cavity, the bullet expands radially outward away from a central longitudinal axis of the inner cavity, wherein the bullet expanding further causes the casing to engage the barrel rifling.

10. The projectile of claim 6, wherein the partially hollow interior is cylindrical.

11. The projectile of claim 1, wherein the casing further comprises an opening along the forward aerodynamic end into the interior cavity.

12. The projectile of claim 11, wherein the opening is sized to allow a forward end of the bullet to extend beyond the forward aerodynamic end upon discharge of the muzzleloader wherein the bullet fully slidably engages the interior cavity of the casing.

13. The projectile of claim 12, wherein a partially hollow interior extends along a longitudinal length of the bullet and is closed along a forward end and is open along a base end of the bullet.

14. The projectile of claim 1, further comprising a tail guide having a forward end configured to be oriented toward a muzzle of the rifle when inserted into a barrel of the rifle, the forward end formed as part of a cylindrical body having a plurality of rifling guides each extending along a partial length of the tail guide longitudinally away from the forward end, each rifling guide of the plurality of rifling guide is oriented side by side around a circumference of the tail guide, wherein each rifling guide is connected to each adjacent rifling guide by a line of weakness.

15. The projective of claim 14, wherein the forward end of the tail guide contacts the free end of the casing after ignition of the propellant and as the projectile travels along a length of the rifled barrel.

16. The projectile of claim 15, wherein each rifling guide separates from each adjacent rifling guide along the line of weakness upon discharge of the muzzleloader rifle.

17. The projectile of claim 16, wherein a free end of each rifling guide together forms an outer edge of a cavity extending within the tail guide, wherein the cavity is shaped to accommodate gun powder.

18. The projectile of claim 16, wherein, upon discharge of the muzzleloader rifle, each rifling guide extends radially outward such that each rifling guide is positioned to contact the barrel rifling of the muzzleloader rifle.

19. The projectile of claim 14, wherein the tail guide contacts a base end of the bullet, oppositely oriented to the front end of the bullet, along the forward end of the tail guide.

20. A firearm projectile, comprising:

a casing having a cylindrical body, a forward aerodynamic end, and a free end opposite the aerodynamic end, at least the cylindrical body defining an interior cavity within the casing extending to and in open communication with the free end; and a bullet sized to slidably engage within and to the casing along at least a partial length of the interior cavity through the free end, wherein a front end of the bullet engages the interior cavity toward a forward surface of the interior cavity and forward aerodynamic end of the casing.

* * * * *